US011351657B1

(12) United States Patent
Kelsay

(10) Patent No.: US 11,351,657 B1
(45) Date of Patent: Jun. 7, 2022

(54) DOOR PANEL SUPPORT ASSEMBLY

(71) Applicant: Daniel Grayson Kelsay, Lakeside, CA (US)

(72) Inventor: Daniel Grayson Kelsay, Lakeside, CA (US)

( * ) Notice: Subject to any disclaimer, the term of this patent is extended or adjusted under 35 U.S.C. 154(b) by 0 days.

(21) Appl. No.: 16/903,410

(22) Filed: Jun. 17, 2020

(51) Int. Cl.
*B25B 1/00* (2006.01)
*B25B 5/04* (2006.01)

(52) U.S. Cl.
CPC ..... *B25B 5/04* (2013.01)

(58) Field of Classification Search
CPC .... B25B 1/04; B25B 1/06; B25B 1/20; B25B 5/04; B25B 5/14; B25B 5/142; B25B 11/00; B25B 11/02
USPC ..... 269/905, 902, 909, 24, 254
See application file for complete search history.

(56) References Cited

U.S. PATENT DOCUMENTS

| | | | | |
|---|---|---|---|---|
| 342,187 | A | 5/1886 | Corell | |
| 1,103,486 | A | 7/1914 | Cobb | |
| 1,715,722 | A | 6/1929 | Smith et al. | |
| 2,621,687 | A | 12/1952 | Joseph | |
| 2,774,622 | A | 12/1956 | Priebe | |
| 2,830,632 | A | 4/1958 | La Rouche | |
| 2,971,548 | A | 2/1961 | House | |
| 4,168,827 | A | 9/1979 | Hutchinson | |
| 4,239,197 | A | 12/1980 | Olstad | |
| 4,270,741 | A | 6/1981 | Hurst | |
| 4,391,437 | A | 7/1983 | Collins | |
| 4,641,822 | A | 2/1987 | Fenerty | |
| 5,082,038 | A | 1/1992 | Teel | |
| 5,090,648 | A | 2/1992 | Wood, IV | |
| 5,164,011 | A | 11/1992 | Ray | |
| 5,294,099 | A | 3/1994 | Dalfino | |
| 5,507,509 | A * | 4/1996 | Della Polla, Jr. | B62B 3/04 269/133 |
| 5,934,659 | A | 8/1999 | Johnson | |
| 6,090,204 | A | 7/2000 | Speed et al. | |
| 6,663,123 | B1 | 12/2003 | Kovacs | |
| 7,806,394 | B2 | 10/2010 | Wuerthner | |
| 8,398,062 | B1 | 3/2013 | Condit | |

(Continued)

FOREIGN PATENT DOCUMENTS

| | | | |
|---|---|---|---|
| GB | 2227201 | A | 7/1990 |
| GB | 2394916 | A | 5/2004 |
| WO | 2006096176 | A1 | 9/2006 |

*Primary Examiner* — Monica S Carter
*Assistant Examiner* — Tam Vu Quang Truong
(74) *Attorney, Agent, or Firm* — Gerben Perrott PLLC; Benjamin M. Hanrahan

(57) ABSTRACT

A panel support assembly is presented herein. The panel support assembly includes a support base, a fixed support structure and a swing arm assembly. The fixed support structure extends from the support base and defines at least one vertical panel engaging surface. The swing arm assembly is pivotally attached to the base and is disposable between a normally biased, at least partially raised position and a lowered, clamped position. The swing arm assembly includes a base, a swing arm panel and a pivoting pressure plate. A biasing device is attached to the base of the swing arm assembly and is configured to normally bias the swing arm assembly into the at least partially raised position until an opposing weight is applied to the base of the swing arm assembly that will oppose the biasing force and automatically position the swing arm assembly into the lowered clamped position.

20 Claims, 7 Drawing Sheets

(56) References Cited

U.S. PATENT DOCUMENTS

| | | | |
|---|---|---|---|
| 8,757,604 | B2 | 6/2014 | Crampton |
| 9,638,224 | B1 | 5/2017 | Westfall |
| 2004/0217532 | A1 | 11/2004 | Eberle |
| 2007/0018417 | A1 | 1/2007 | Ponce |
| 2009/0033014 | A1 | 2/2009 | Crampton |
| 2009/0095569 | A1 | 4/2009 | Cooper et al. |
| 2010/0156018 | A1 | 6/2010 | Maire |
| 2010/0225039 | A1 | 9/2010 | MacLean |
| 2014/0021670 | A1 | 1/2014 | Geraghty |
| 2015/0026959 | A1 | 1/2015 | Dumas et al. |

* cited by examiner

DOOR PANEL SUPPORT ASSEMBLY

FIELD OF THE INVENTION

The present invention is generally directed to a support assembly, and in particular to a support assembly that will automatically clamp or engage onto a door or other planar structure in order to maintain the planar structure in an upright position.

BACKGROUND OF THE INVENTION

Performing carpentry and other work on a door, for example, planing, milling, sanding or installing hardware such as hinges or lock assemblies, can be challenging, particularly since working on a door while holding the door in an upright position on its edge can be challenging and a hassle. Accordingly, use of a device or clamp that can hold the door in the upright position while work is being performed upon the door is desired. There are some devices and clamps which are intended to accomplish the goal of maintaining the door in an upright position, however, many of such devices or solution are cumbersome and ineffective. In addition, many do not provide for the automatic clamping and removal of the door therefrom without additional hardware or manual assistance.

Accordingly, there is a need in the art for a support assembly that is capable of automatically supporting a door in an upright position which uses the weight of the door to operate or activate the clamping action. It would also be advantageous if the proposed support assembly includes one or more positioning rollers which facilitates the automatic positioning of the door within the clamp during the automatic clamping action without causing damage to the door or the support assembly.

SUMMARY OF THE INVENTION

The present invention is directed to a support assembly that is configured to automatically close or clamp upon a door or other like planar structure when the door or other planar structure is inserted into the support assembly. When supported or clamped via the support assembly of the present invention, the door or other planar structure can be planed, milled, sanded, cut, or otherwise worked upon, including by installing hinges and lock sets. The support assembly of the present invention is intended to make it quick and easy to secure the door or other planar structure in an upright position while the work is being executed. The clamping mechanism of the present invention operated from the weight of the door being imposed thereupon.

In certain embodiments, the support assembly includes a main support base, a fixed support structure and a pivoting or movable swing arm assembly. As the door or other structure is lowered into the support assembly, for example, between the fixed support structure and the pivoting or movable swing arm, the weight of the door or other structure causes the swing arm assembly to automatically clamp onto the door, holding it in an upright position. Removal of the door is accomplished by lifting the door out of the support structure, which removes the weight of the door from the support assembly, and thereby causes the swing arm assembly to automatically reposition back into a normally biased orientation and ready to receive and clamp onto another door. In this manner, the door or other planar structure can be supported or clamped by the support assembly and removed from the support assembly without the use of additional tools or mounting hardware.

Some components of the support assembly, such as the main base, the fixed support structure, and portion of the swing arm assembly, including the swing arm base, swing arm panel and pressure plate can be constructed from hard solid maple wood, Baltic birch ply wood and certain high grade hardware in order to form assembly attachments. Other materials, including plastics, metal, etc. are contemplated within the full spirit and scope of the present invention. These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1A:
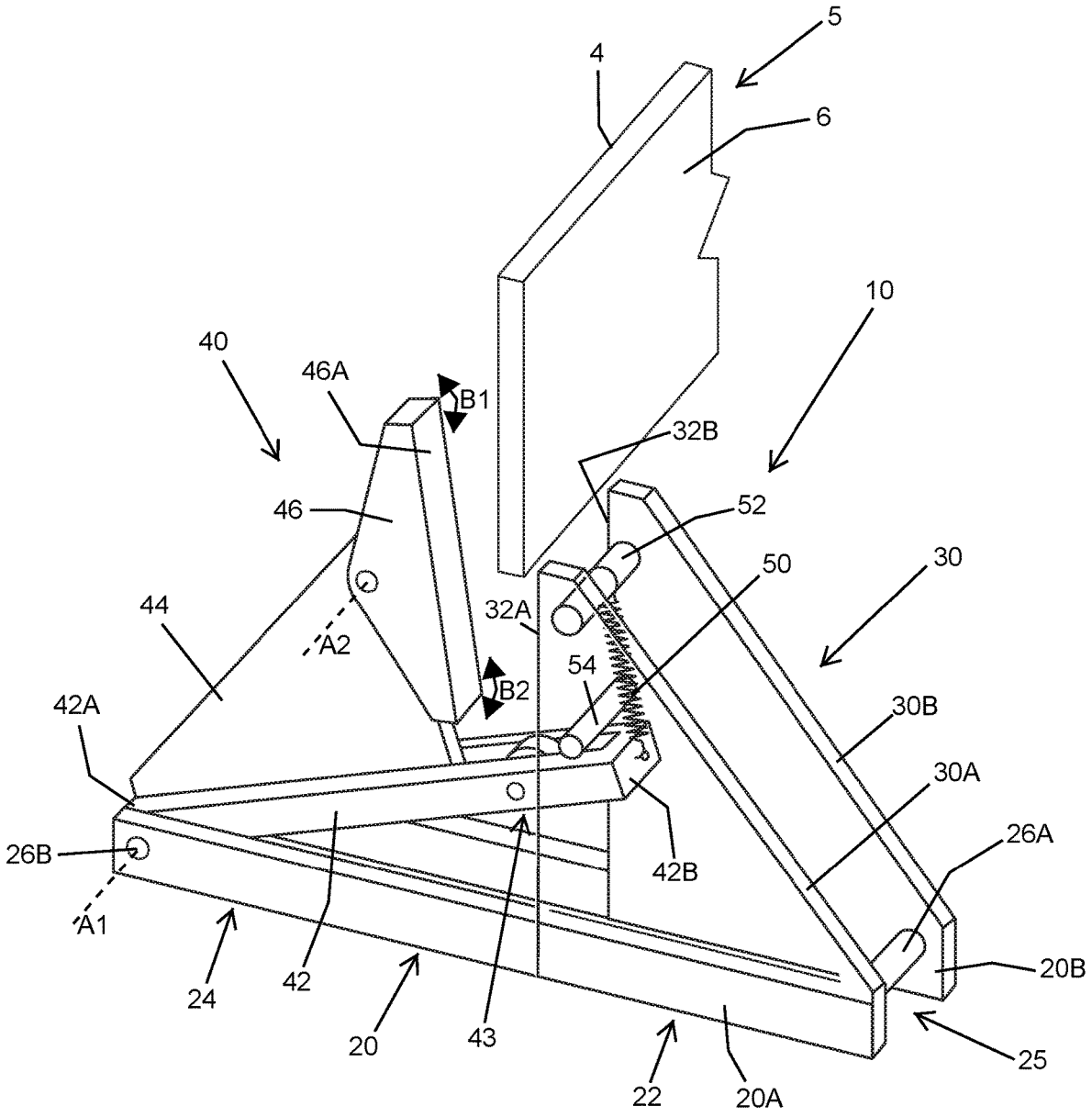
FIG. 1A is a front perspective view of the support assembly as disclosed in accordance with at least one embodiment of the present invention, with the swing arm assembly disposed in a normally biased, at least partially raised position, and with a portion of a fixed support structure illustrated as being partially transparent for illustrative purposes only.
Figure 1B:
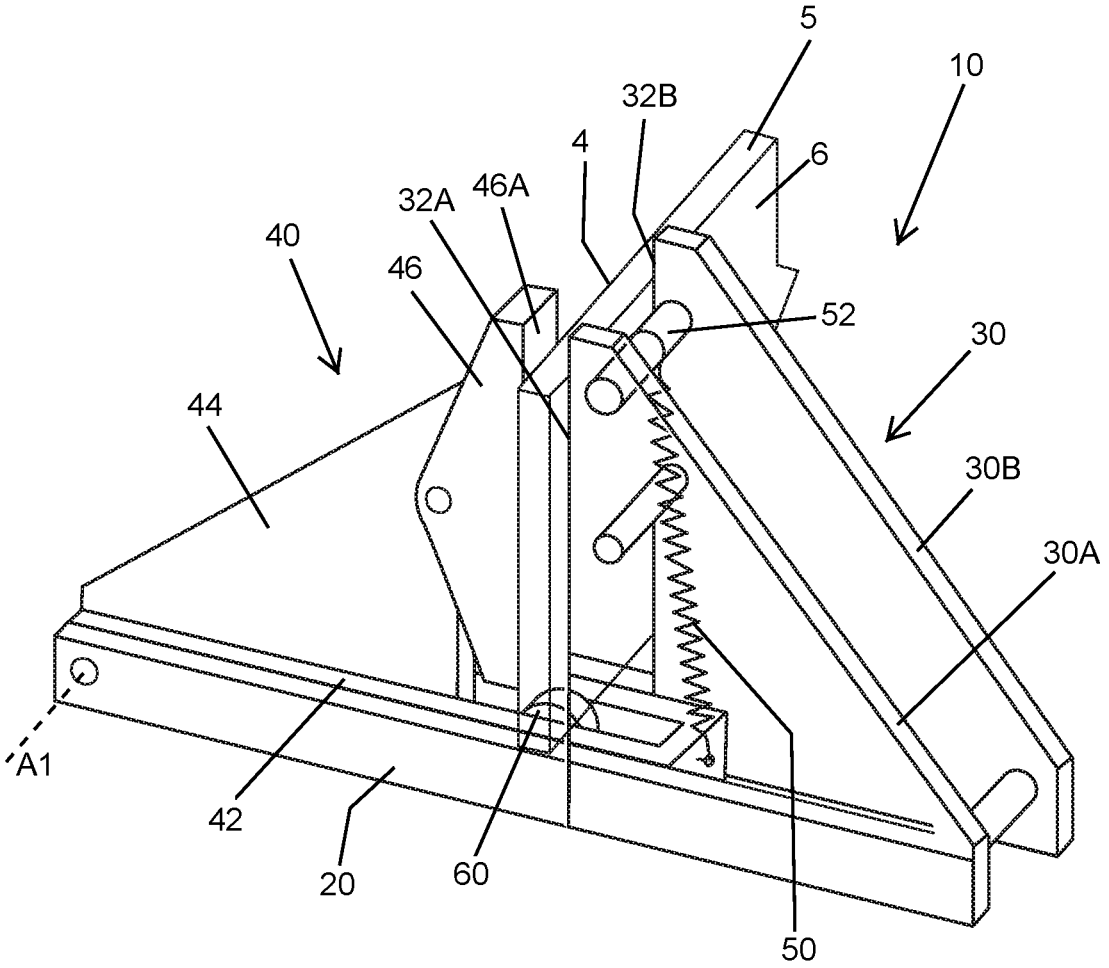
FIG. 1B is a front perspective view of the support assembly as disclosed in accordance with at least one embodiment of the present invention, with the swing arm assembly disposed in a lowered, clamped position, and with a portion of a fixed support structure illustrated as being partially transparent for illustrative purposes only.
Figure 1C:
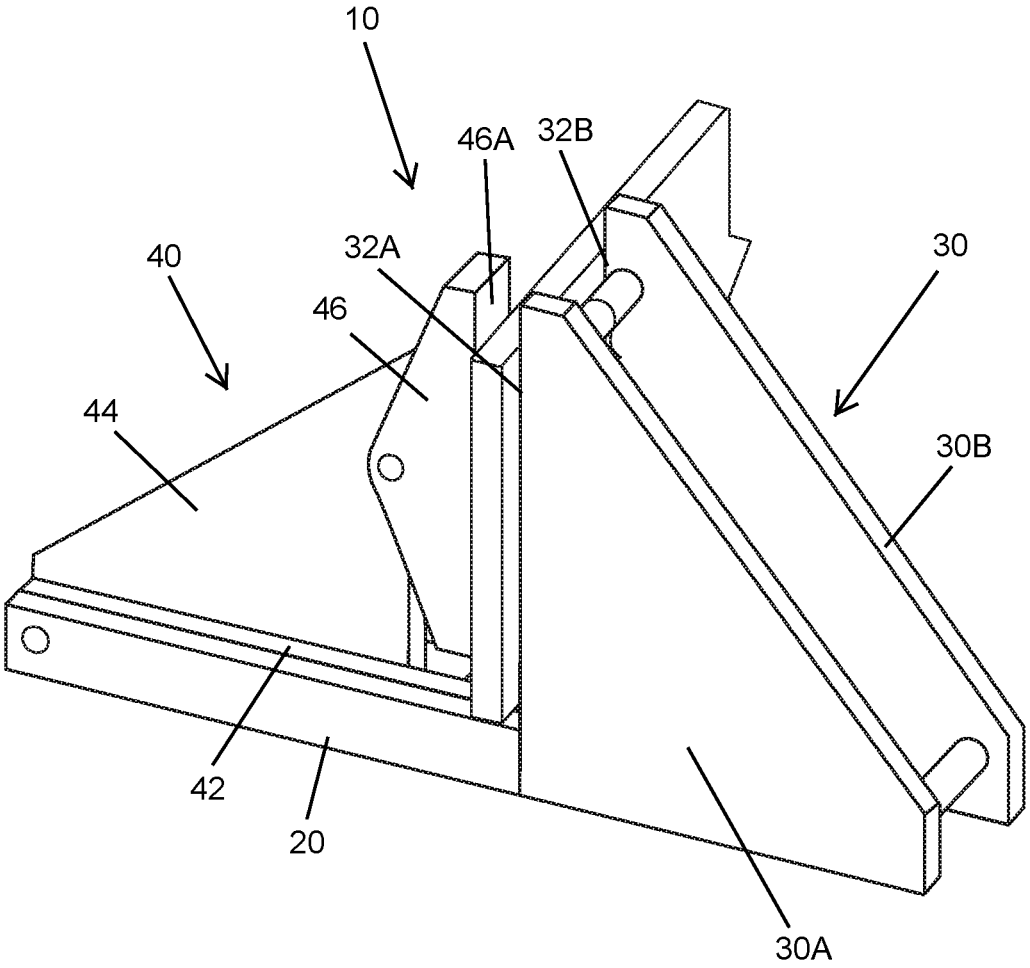
FIG. 1C is another front perspective view of the support assembly as disclosed in accordance with at least one embodiment of the present invention, with the swing arm assembly disposed in a lowered, clamped position.

As shown in the accompanying drawings, and with particular reference to FIGS. 1A, 1B and 1C, the present invention is generally directed to a support assembly, referenced as 10, which can be used to automatically hold or retain a door, board, panel or other planar structure 5. In particular, using the weight of the panel 5 or other structure, the support assembly 10 of at least one embodiment of the present invention will automatically close or clamp onto or otherwise engage opposing planar surfaces 4, 6 to maintain the panel 5 in an upright position. While the panel 5 is in the retained, clamped or upright position held by the support assembly 10 of the present invention (e.g., as shown in FIGS. 1B and 1C), a user is able to easily work on the panel 5, for example, by trimming, planing, milling, sanding, setting hinges or lock sets, etc. Removal of the panel from the support assembly 10 of at least one embodiment is accomplished by simply lifting the panel 5 out of the support assembly 10, which causes the support assembly 10 to automatically return to its normally biased, resting position, ready for another panel. In this manner, the support assembly 10 of at least one embodiment is operable without the use of any tools in that it automatically clamps onto the panel simply through the weight of the panel and automatically releases the panel when the panel is simply raised or removed therefrom.

More in particular, the support assembly 10 of at least one embodiment of the present invention may include a support base 20 which can be set on the floor, a work bench or other support surface. In at least one embodiment, the support base 20 includes an elongated configuration defining a first longitudinal half or end 22 and a second longitudinal half or end 24. In some cases, the base 20 may be constructed of out of two parallel beams or pieces 20A, 20B defining a space or channel 25 there between. In this manner, the two beams or pieces 20A, 20B may be connected to one another via one or more connectors 26A, 26B, such as dowels, pins, cross beams, cross connectors, etc. As will be described herein, a swing arm assembly 40 may, in some embodiments, pivot at least partially into and out of the space or channel 25 defined by the base 20.

Figure 2A:
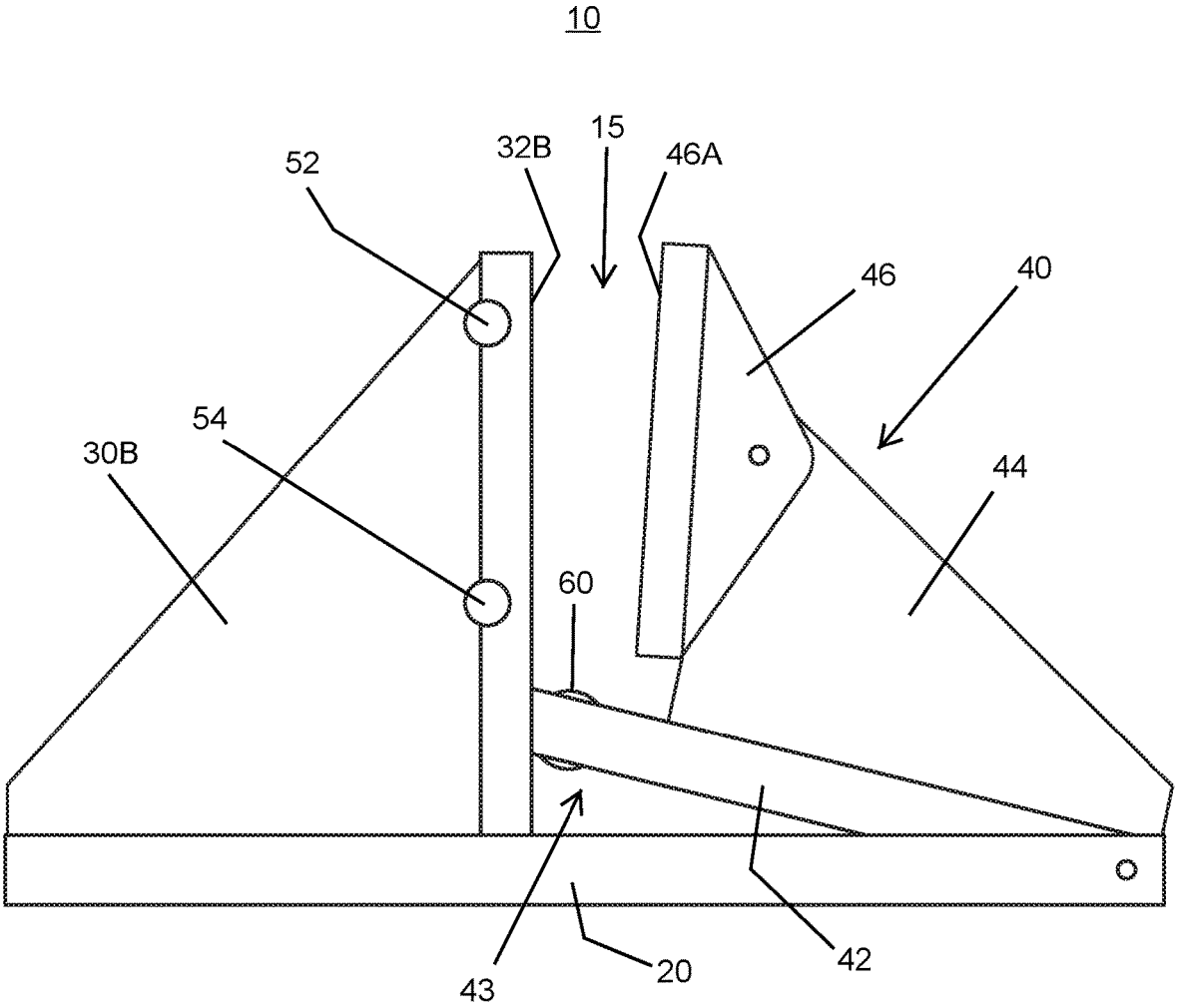
FIG. 2A is a rear elevation view of the support assembly as disclosed in accordance with at least one embodiment of the present invention, with the swing arm assembly disposed in a normally biased, at least partially raised position.
Figure 2B:
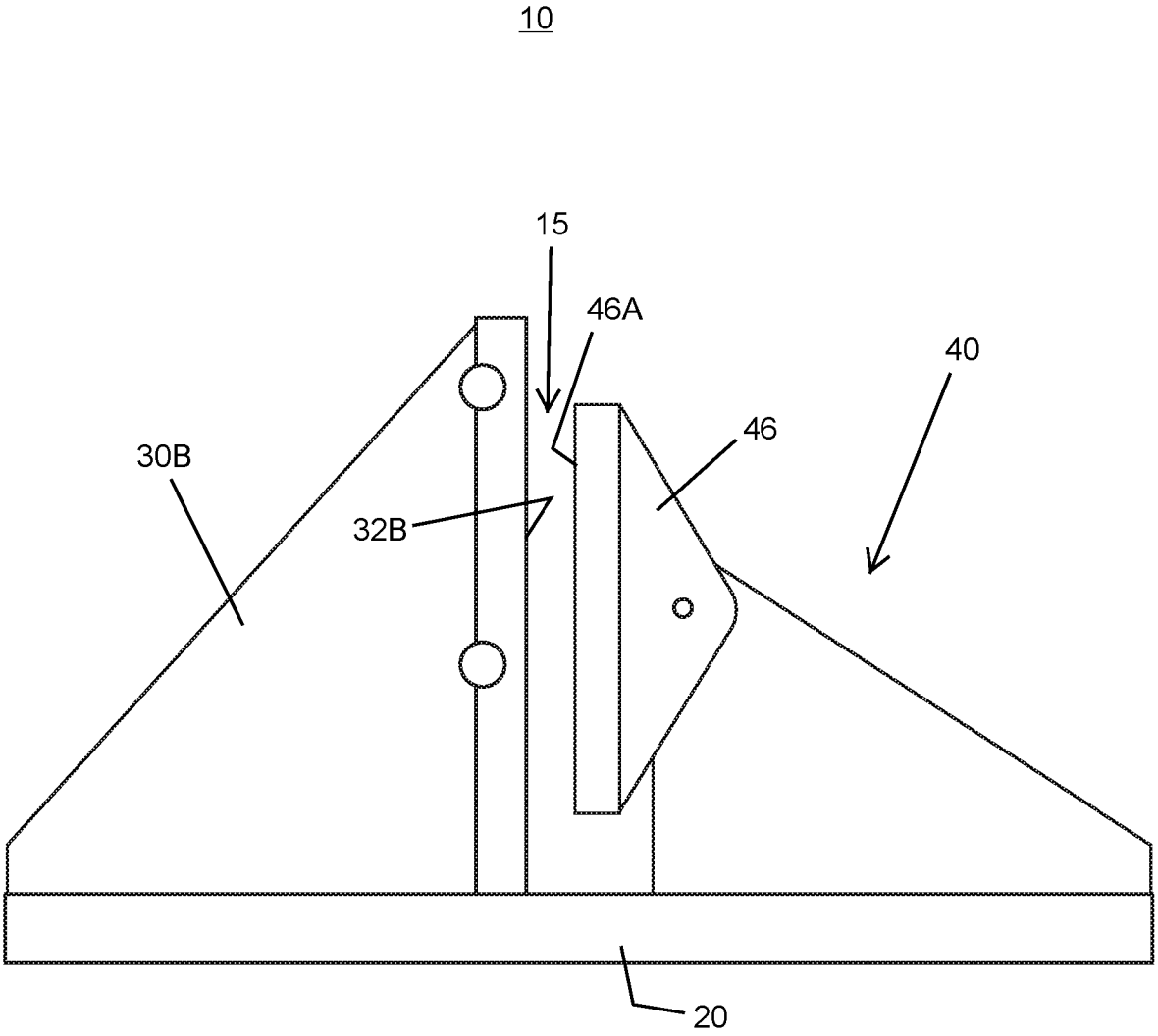
FIG. 2B is a rear elevation view of the support assembly as disclosed in accordance with at least one embodiment of the present invention, with the swing arm assembly disposed in a lowered, clamped position, but without a panel disposed therein for illustrative purposes.

Furthermore, and still referring to FIGS. 1A, 1B and 1C, as well as FIGS. 2A and 2B, the support assembly 10 of at least one embodiment also includes a fixed support structure 30, which can extend either directly or indirectly from the support base 20. In the embodiment shown, the fixed support structure 30 extends in an upward direction from the first longitudinal half or end 22 of the support base 20, although other locations or connections, whether direct or indirect, between the support base 20 and the fixed support structure 30 are contemplated within the full spirit and scope of the present invention.

Specifically, the fixed support structure 30 defines at least one panel engaging surface 32A, 32B upon which the supported panel 5 will contact or engage, as described herein. The at least one panel engaging surface 32A, 3B of the fixed support structure 30 of at least one embodiment extends or is disposed in a vertical or substantially vertical orientation orthogonal or perpendicular to the base 20 or the longitudinal axis of the base 20. In this manner, as the panel 5 is supported by the support assembly 10, and in particular against the one or more panel engaging surfaces 32A, 32B of the fixed support structure 30, the panel 5 will be oriented in a vertical position. It should be noted, however, that the panel engaging surface(s) 32A, 32B of at least one embodiment may be angled relative to the base 20 or otherwise not disposed in a vertical or substantially vertical orientation.

Furthermore, in the embodiments shown, the fixed support structure 30 includes two fixed support panels 30A, 30B extending in an upward direction from the support base 20. For instance, a first fixed support panel 30A may extend, either directly or indirectly, from the first beam or piece 20A of the base 20 or from a first longitudinal side of the base 20, while the other or second fixed support panel 30B may extend, either directly or indirectly, from the second beam or piece 20B of the base 20 or from a second longitudinal side of the base 20. In this manner, each of the two fixed support panels 30A, 30B of at least one embodiment define a corresponding panel engaging surface 32A, 32B, respectively. However, in other embodiments, a single fixed support panel or more than two fixed support panels are contemplated without departing from the intended operation of the support assembly 10.

It should also be noted that the fixed support structure 30, including the first and second fixed support panels 30A, 30B of at least one embodiment, may be integral with the base 20 or separate from and fixedly connected to the base 20. Either way, the fixed support structure 30 of at least one embodiment is fixed to the base 20, either directly or indirectly, in a manner such that it does not move, pivot or rotate relative to the base 20. This provides a static and steady panel engaging surface 32A, 32B upon which the panel 5 may be supported during operation of at least one embodiment of the present invention. In other embodiments, an at least partially movable support structure is contemplated to replace the fixed support structure without departing from the intended operation of the present invention.

Still referring to FIGS. 1A through 2B, at least one embodiment of the present invention further includes a swing arm assembly, generally referenced as 40. The swing arm assembly 40 of at least one embodiment is pivotal or otherwise movable relative to the base 20, which, as described herein, causes the support assembly 10 to automatically clamp or engage onto a panel 5.

More specifically, the swing arm assembly 40 of at least one embodiment may be connected to or extend from, either directly or indirectly, the second longitudinal half or end 24 of the base 20. In this manner, the fixed support structure 30 is disposed on one end or half of the base 20 and the swing arm assembly 30 is disposed on the other opposing end or half of the base 20, however, other configurations are contemplated without departing from the intended operation of at least one embodiment of the present invention.

Furthermore, in at least one embodiment, the swing arm assembly 40 includes a base 42, a swing arm panel 44 and a pressure plate 46. More specifically, the base 42 of the swing arm assembly 40 includes a first end 42A and a second end 42B disposed at opposing longitudinal ends of the base 42. Moreover, the swing arm assembly 40, and in particular, the base 42 of at least one embodiment is pivotal about a pivot axis A1, as shown in FIG. 1B, for example. In this embodiment, the pivot axis A1 is disposed laterally through the base 42 at a location proximate to the first end 42A thereof. Additionally, in the embodiment illustrated in FIG. 1B, the base 42 of the swing arm assembly 40 is connected to the support base 20 at a pivot axis A1 via a connector 26B, allowing the base 42 and the swing arm assembly 40 to pivot between a normally biased, at least partially raised position (e.g., as shown in FIG. 1A) and a lowered or clamped position (e.g., as shown in FIGS. 1B and 1C).

For example, the normally biased, at least partially raised position of at least one embodiment is defined as the base 42 of the swing arm assembly being angularly disposed relative to the support base 20 with the support assembly 10 in a state to receive a panel 5 (e.g., in a normally rested state without supporting a panel). The lowered or clamped position is defined as the swing arm assembly being disposed in a clamped or engaging relation to a panel, such that the swing arm assembly 40 and base 42 thereof is disposed in a position lower that the normally biased position. As described herein, depending on the thickness of the panel 5, while disposed in the lowered, clamped position, the swing arm assembly 40 may or may not be completely lowered, and thus, depending on the thickness of the panel, the base 42 of the swing arm assembly may be angularly disposed relative to the support base 20 or parallel to the support base 20.

Moreover, and still referring to FIGS. 1A through 2B, the swing arm panel 44 of at least one embodiment extends, either directly or indirectly, from the swing arm base 42. The pressure plate 46 is then movably or at least partially pivotally attached to an edge of the swing arm panel 44. While the embodiment illustrated shows the swing arm panel 44 as being a separate piece than the base 42, in other embodiments, the swing arm panel 42 and the base 42 may be integrally formed from a single piece or formed by multiple pieces. In at least one embodiment, however, the swing arm panel 44 is fixed to the base 42 such that the swing arm panel 44 is not independently movable relative to the base 42, but instead moves or pivots with the base 42.

As mentioned above, the pressure plate 46 is movably or pivotally attached to the swing arm panel 44, for example, on an edge thereof such that the pressure plate 46 at least partially moves or pivots about axis A2, for example along trajectory B1, B2 shown in FIG. 1A. In this manner, pressure plate 46 may be attached to the swing arm panel 44 via a single point, dowel or pin at axis A2 to allow for the movement thereof. As described herein, the pivoting of the pressure plate allows the flat surface 46A of the pressure plate to abut flat against the corresponding surfaces 4 of panel 5 having different thicknesses.

For instance, pressure plate 46 defines a panel engaging surface referenced as 46A that is disposed in a spaced relation from panel engaging surface(s) 32A, 32B of the fixed support structure 30. As described herein, this spacing between the panel engaging surface 46A of the pressure plate 46 and the panel engaging surface(s) 32A, 32B of the fixed support structure 30 at least partially defines a panel engaging area or opening 15 within which a panel 5 is disposed and supported by the support assembly 10 of the present invention.

Furthermore, in at least one embodiment, the pressure plate 46 is disposed at least partially offset from the second end 42B of the base 42 of the. swing arm assembly 40. In other words, the base 42 of at least one embodiment extends longitudinally beyond the pressure plate 46 in that an offset portion 43 of the base 42 is defined as a portion of the base 42 which extends longitudinally past or beyond the pressure plate 46 and/or swing arm panel 44, as generally illustrated in FIG. 1A.

Moreover, in at least one embodiment, the offset portion of the base 42 of at least one embodiment extends beyond the panel engaging surface(s) 32A, 32B of the fixed support structure 30, as illustrated, for example, in FIGS. 1A and 1B. Specifically, a portion of the fixed support structure 30 is illustrated in FIGS. 1A and 1B as being transparent in order to show the second end 42B or offset portion 43 of the base 42 extending into the fixed support structure 30. More in particular, the end of the fixed support structure 30 which defines the panel engaging surface(s) 32A, 32B may be spaced from one another defining an opening or channel within which the second end 42B or offset portion 43 of the swing arm base 42 can move, for instance, between the at least partially raised position, as shown in FIG. 1A and the lowered or clamped position, as shown in FIG. 1B.

Additionally, in at least one embodiment, a biasing device 50 is attached to the swing arm assembly 30 in order to normally bias the swing arm assembly 30 into the at least partially raised position, at least until a weight or opposing force is applied thereto, such as, by placing a panel 5 within the panel support area 15 and resting the panel 5 upon the base 42 of the swing arm assembly 40. In any event, the biasing device 50, of at least one embodiment, may be a coiled or other spring, as illustrated, or other device or structure capable of biasing the swing arm assembly 40 into an intended position, such as the at least partially raised position, as described herein.

Figure 3:
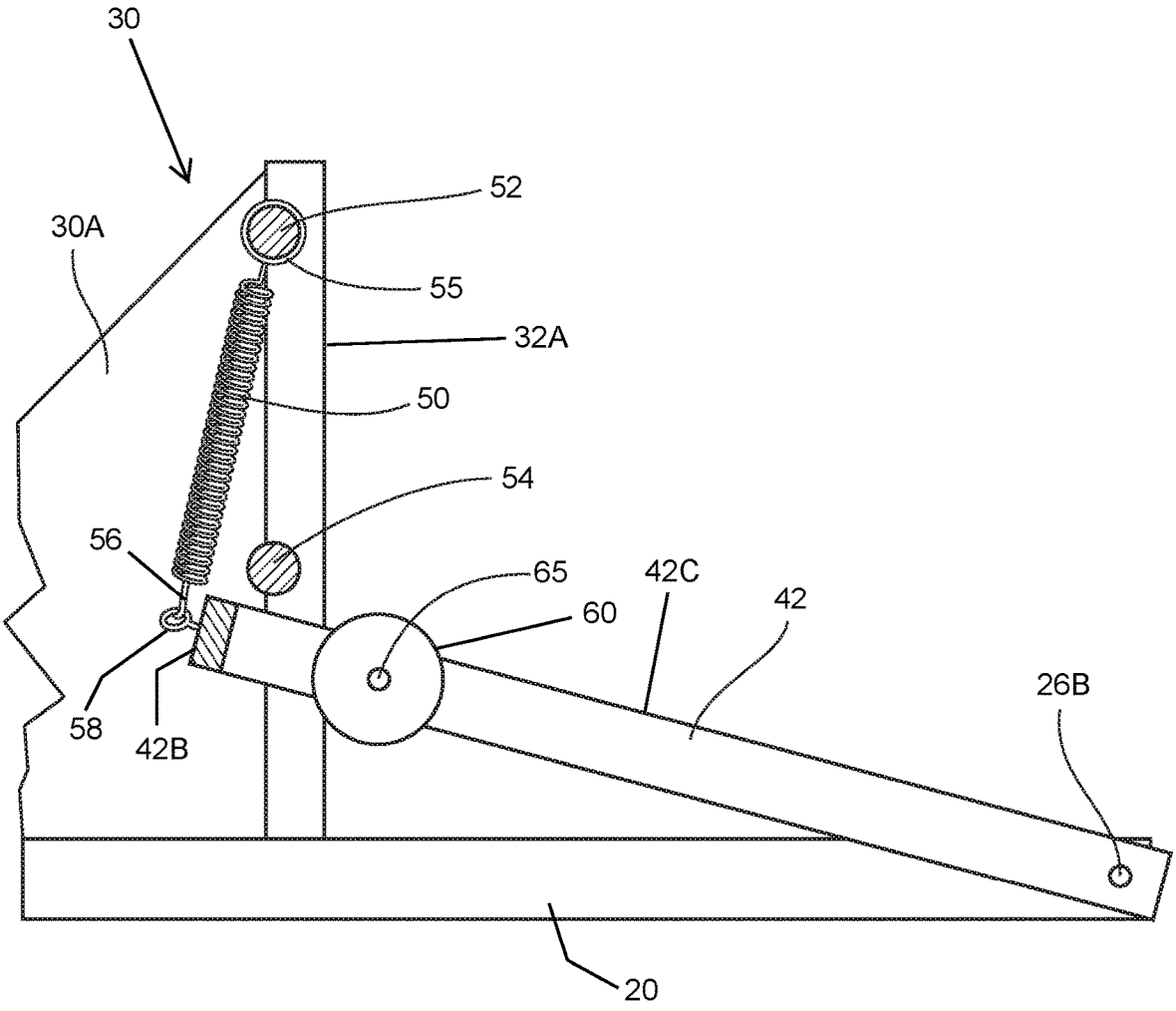
FIG. 3 is a partial cut-away view of the support assembly as disclosed in accordance with at least one embodiment of the present invention.

In other words, in the normal resting position, the swing arm assembly 40 of at least one embodiment is biased into the at least partially raised position, as illustrated in FIG. 1A. In this example, the biasing device 50 is attached to an end, such as the second end 42B, of the base 42 of the swing arm assembly 40 and to a bias support structure or dowel 52 disposed at a location above or higher than the base 42 (e.g., not necessarily directly above or vertically aligned with the base 42). For instance, with reference briefly to FIG. 3, the biasing device 50 of at least one embodiment is attached to a support dowel 52 via support ring 55 at the top end. At the bottom end, biasing device 50 may be attached to the second end 42B of the base 42 via cooperative hook 56 and eyelet 58 screwed or embedded into the base 42. Other attachment structures, at the top and/or bottom of the biasing device 50 are contemplated within the various embodiments of the present invention.

In any event, in this embodiment, the biasing device 50 will normally pull the swing arm base 42, and in particular, the second end 42B of the swing arm base 42, upward and into the normally biased at least partially raised position, as illustrated in FIG. 1A. In this embodiment, the biasing device 50 may be at least partially compressed when the swing arm assembly 40 is disposed in the at least partially raised position. Application of a sufficient opposing downward force upon the swing arm assembly 40 (e.g., via the weight of a panel 5) may cause the biasing device 50 to at least partially expand or extend while the swing arm assembly 40 is disposed into the lowered or clamped position. In such a case, removal of the sufficient opposing downward force will cause the biasing device 50 to again compress or at least partially compress, thereby pulling the base 42 upward and back into the normally biased, at least partially raised position.

Furthermore, in at least one embodiment, a stop 54 may be included to which the base 42 of the swing arm assembly 40 will engage or abut against when the swing arm assembly 40 is disposed in the normally biased at least partially raised position. For example, the stop 54 may be disposed above the second end 42B of the base 42 or above the offset portion 43 of the base 42 such that the biasing device 50 will pull the base 42 upward until the base 42 engages or abuts against the stop 54. The base 42 and swing arm assembly 40 of at least one embodiment will therefore remain in the at least partially raised position with the base 42 engaged against the stop 54 until an opposing downwardly directed force is applied to the swing arm assembly 40, for example, by the weight of a panel 5. In the embodiment shown, the stop 54 is disposed between first and second panels 30A, 30B of the fixed support structure 30.

It should be noted, however, that in other embodiments, the biasing device 50 and/or the stop 54 may be disposed in other locations. For example, the biasing device 50 of other embodiments may exert a different biasing force upon the base 42 in order to normally bias the base 42 and therefore the swing arm assembly 40 into to the at least partially raised position. For example, a biasing device may be disposed beneath the base 42 and may therefore push the base 42 upward until an opposing downward force causes the biasing device to compress, thereby disposing the swing arm assembly 40 in the lowered or clamped position. In such a case, releasing of the opposing downward force may cause the biasing device to extend or expand, pushing the base 42, and therefore the swing arm assembly 40, upward and back into the at least partially raised position.

Additional features of at least one embodiment of the present invention include at least one roller 60 disposed on the offset portion 43 of the base 42 and at least partially extending into the panel support area 15. Specifically, as the panel 5 is lowered into the panel support area 15, the panel 5 will engage the roller 60 which automatically positions the panel 5 into the center of the panel engaging area 15 without causing damage to the panel 5 or the base 42.

For example, the support assembly 10 of the present invention is intended to be operable with panels 5 having different widths or thicknesses (e.g., the distance between opposing surfaces 4, 5 of the panel 5). Regardless of the width or thickness of the panel 5, the roller(s) 60 of at least one embodiment are configured to engage the panel 5 while the swing arm assembly 40 is simultaneously being disposed from the normally biased at least partially raised position into the lowered clamped position. In this manner, as the swing arm assembly 40, and in particular the pressure plate 46 thereof, moves toward the panel 5, the roller 60 facilitates the easy movement of the panel 5 in a direction toward or away from the pressure plate 46 or fixed support structure 30 without damaging the panel 5 or the base 42 of the swing arm 40. In other words, without the roller(s) 60 of at least one embodiment of the present invention, the bottom surface of the panel 5 (e.g., the surface of the panel 5 facing the base 42 of the swing arm assembly 40) may be damaged or scratched if the panel 50 moves or scrapes along the base 42 toward or away from the pressure plate 46 or fixed support structure 30 as the swing arm assembly 40 moves between the at least partially raised position and into the clamped position. Furthermore, without the roller(s), scraping or sliding of the panel 5 along the base 42 may also cause damage to the base 42.

In any event, as shown, the roller(s) 60 or wheels of at least one embodiment extend at least partially into the panel support area 15, which may be defined as the area between the pivoting pressure plate 46 and the fixed support structure 30 (such as between the respective panel engaging surfaces 46A, 32A, 32B thereof) and above at least a section of the offset portion 43 of the base 42. In the embodiment illustrated, and with reference to FIGS. 3, 4A and 4B, for example, the one or more rollers 60 is connected to the base 42 of the swing arm assembly 40 and is at least partially recessed into the base 42 such that only a portion of the roller(s) 60 extend above a top surface 42C of the base 42.

Furthermore, the roller(s) 60 of at least one embodiment may be connected or mounted to the base 42 via one or more pins or axels 65 such that the roller(s) rotate about an axis A3 and in a direction toward either one or both of the pressure plate 46 and/or fixed support structure 30 in a manner to position the panel 5 as described above.

Figure 4A:
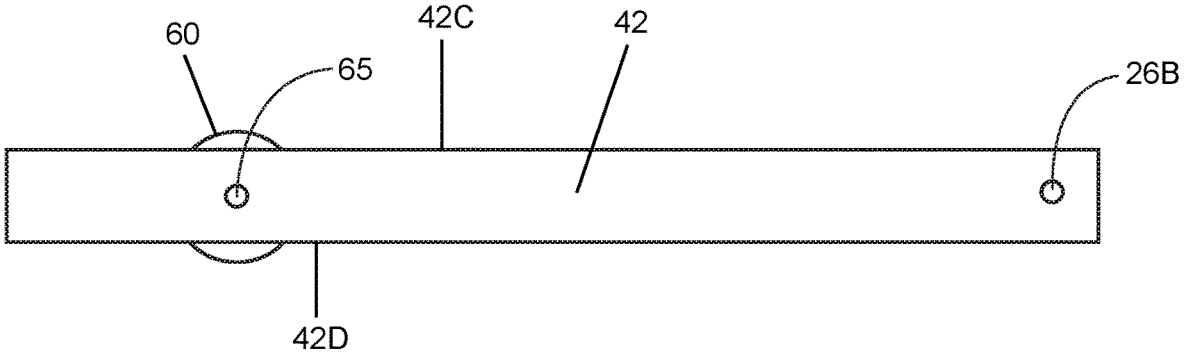
FIG. 4A is a side view of the swing arm base as disclosed in accordance with at least one embodiment of the present invention.
Figure 4B:
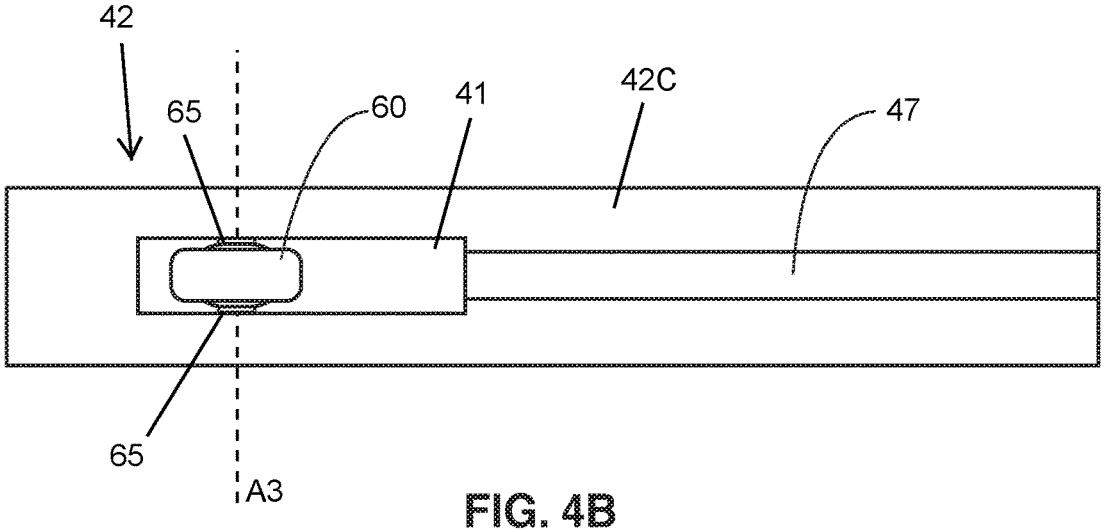
FIG. 4B is a top view of the swing arm base as disclosed in accordance with at least one embodiment of the present invention.

More in particular, with reference to the top view of swing arm base 42 illustrated in FIG. 4B, the swing arm base 42 may include an opening, hole or recess 41 within which the roller(s) 60 is mounted via axel or pin 65 for rotation about axis A3. The embodiment illustrated shows an opening entirely through the base 42, such that the roller 60 extends beyond the top 42C and bottom 42D surfaces, as shown in FIG. 4A. However, in other embodiments, the roller 60 may only extend beyond the top surface 42C, and thus, the roller 60 may be mounted within a recess that does not necessarily pass entirely through the base 42.

Moreover, a rut or recessed channel 47 may also be included longitudinally along a portion of the base 42. In the embodiment shown, swing arm panel 44 may mount to and extend upward from the base 42 from the rut or channel 47.

Accordingly, in operation, the support assembly 10 of at least one embodiment begins in the normal resting position with the swing arm assembly 40 disposed in the normally biased, at least partially raised position, as generally illustrated in FIG. 4A, for example. A panel 5, including, but in no way limited to a planar door, plank, wood panel, etc. is positioned within the panel support area 15 in a vertical orientation with opposing surfaces 4 and 6 facing the swing arm assembly 40 and fixed support structure 30, as generally illustrated in FIG. 1A. As the bottom surface of the. panel 5 engages the base 42 of the swing arm assembly 40, the weight of the panel 5 and gravity causes the swing arm assembly 40 to be lowered down, against the pull of the biasing device 50.

While the swing arm assembly 40 is lowered, the roller(s) 60 of at least one embodiment simultaneously positions the panel 5 into the center of the panel support area 15 without causing damage to either the panel 5 or the base 42.

As the pressure plate 46 of the swing arm assembly contacts or engages the facing surface 4 of the panel 5, the pressure plate will pivot or move, for example, about axis A2, such that the flat or planar surface 46A of the pressure plate 46 engages completely against the surface 4 of the panel 5. More specifically, since the support assembly 10 of the present invention is intended to be operable with panels 5 of different thicknesses, the pivoting pressure plate 46 allows the flat surface 46 thereof to abut flat against the surface 4 of the panel 5, regardless of the thickness of the panel 5. More in particular, in some cases, for example depending on the thickness of the panel, the swing arm assembly 40 may not be disposed in a fully lowered position. As an example, FIG. 1B shows the swing arm assembly 40 disposed in a fully lowered position such that the swing arm base 42 is horizontal and disposed completely within the opening 25 defined by the support base 20. If the panel 5 has a larger thickness, the swing arm base 42 will not lay flat (e.g., it will not be disposed in a horizontal orientation) while the swing arm assembly 40 is disposed in the clamped orientation, with the pressure plate 46 and the fixed support structure 30 engaging and support opposing surfaces 4, 6 of the panel 5. In such a case, the pressure plate 46 will pivot downward in a manner such that the flat panel engaging surface 46A thereof will still fully engage, or otherwise be parallel and against the corresponding flat surface 4 of the panel.

Removal of the panel 5 from the support assembly 10 is accomplished simply by lifting the panel 5 out of the panel support area 15. Doing so will release the opposing force exerted upon the base 42 of the swing arm by the weight of the panel 5, thereby causing the biasing device to again automatically position the swing arm assembly into the normally biased, at least partially raised position, and ready to support another panel.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. A panel support assembly, comprising:

a support base, at least one fixed support panel extending upward from said support base, said at least one fixed support panel defining at least one panel engaging surface, a swing arm assembly comprising a base defining a first end and a second end, wherein said swing arm assembly is pivotal about a pivot axis, said swing arm assembly being pivotally disposable between an at least partially raised position and a clamped position, said swing arm assembly further comprising a pivoting pressure plate disposed at least partially offset from said second end of said base, said pivoting pressure plate defining a panel engaging surface thereon, said pivoting pressure plate being at least partially movable, a biasing device configured to normally bias said swing arm assembly into said at least partially raised position until an opposing weight is applied to said base of said swing arm assembly to position said swing arm assembly into said clamped position, wherein said panel engaging surface of said pivoting pressure plate and said at least one panel engaging surface of said at least one fixed support panel are disposed in an at least partially facing and spaced relation to one another, wherein a panel support area is defined as being between said pivoting pressure plate and said at least one fixed support panel, and above a portion of said base of said swing arm, and wherein said swing arm assembly further comprises at least one roller disposed on said portion of said base of said swing arm.

2. The panel support assembly as recited in claim 1 wherein said roller is disposed at least partially within said panel support area.

3. The panel support assembly as recited in claim 2 wherein said at least one roller at least partially extends above a top surface of said base of said swing arm assembly.

4. The support assembly as recited in claim 2 wherein said at least one roller rotates about a roller axis in a direction toward at least one of said pivoting pressure plate and said fixed support panel.

5. The support assembly as recited in claim 1 wherein said swing arm assembly further comprises a swing arm panel extending from said base of said swing arm assembly.

6. The support assembly as recited in claim 5 wherein said pivoting pressure plate is pivotally attached to said swing arm panel.

7. The support assembly as recited in claim 1 wherein said at least one fixed support panel comprises a first fixed support panel and a second fixed support panel disposed in a laterally spaced relation from one another.

8. The support assembly as recited in claim 7 wherein said base of said swing arm assembly extends at least partially between said first fixed support panel and said second fixed support panel, at least while said swing arm assembly is disposed in said at least partially raised position.

9. The support assembly as recited in claim 8 further comprising a stop disposed between said first fixed support panel and said second fixed support panel, wherein said base of said swing arm assembly engages said stop while said swing arm assembly is disposed in said at least partially raised position.

10. The support assembly as recited in claim 9 wherein said biasing device is connected between said second end of said base of said swing arm assembly and a biasing support disposed above said base of said swing arm assembly.

11. The support assembly as recited in claim 10 wherein said biasing support is disposed between said first fixed support panel and said second fixed support panel, and wherein said biasing device is configured to pull said base of said swing arm into said at least partially raised position.

12. A panel support assembly, comprising:

a support base defining opposing longitudinal ends, a fixed support structure extending from a first one of said opposing longitudinal ends of said support base, said fixed support structure defining at least one vertical panel engaging surface, a swing arm assembly extending from a second one of said opposing longitudinal ends of said support base, said swing arm assembly comprising a base defining a first end and a second end, wherein said swing arm assembly is pivotal about a pivot axis disposed through said base proximate said first end of said base, said swing arm assembly further comprising a swing arm panel extending from said base and a pressure plate movably attached to said swing arm panel, said pressure plate defining a panel engaging surface disposed in a spaced relation from said vertical panel engaging surface of said fixed support structure, a biasing device attached to said base of said swing arm assembly, said biasing device being configured to normally bias said swing arm assembly into an at least partially raised position until an opposing weight is applied to said base of said swing arm assembly to position said swing arm assembly into a lowered clamped position, wherein a panel support area is defined as being at least partially between said pressure plate and said fixed support structure, and wherein said swing arm assembly further comprises at least one roller disposed on an offset portion of said base and at least partially extending into said panel support area.

13. The panel support assembly as recited in claim 12 wherein said at least one roller is positioned to engage a panel disposed within said panel support area.

14. The support assembly as recited in claim 13 wherein said fixed support structure comprises a first fixed support panel and a second fixed support panel defining a lateral space there between.

15. The support assembly as recited in claim 14 wherein said offset portion of said base of said swing arm assembly at least partially extends between said first fixed support panel and said second fixed support panel, at least while said swing arm assembly is disposed in said at least partially raised position.

16. The support assembly as recited in claim 15 further comprising a stop disposed between said first fixed support panel and said second fixed support panel above said offset portion of said base of said swing arm assembly, wherein said base of said swing arm assembly engages said stop while said swing arm assembly is normally biased in said at least partially raised position.

17. The support assembly as recited in claim 15 wherein said biasing device is configured to pull said base of said swing arm into said at least partially raised position, at least until an opposing downward force is exerted upon said offset portion of said base.

18. A panel support assembly, comprising:

a support base, at least one fixed support panel extending upward from said support base, said at least one fixed support panel defining at least one panel engaging surface, wherein said at least one fixed support panel comprises a first fixed support panel and a second fixed support panel disposed in a laterally spaced relation from one another, a swing arm assembly comprising a base defining a first end and a second end, wherein said swing arm assembly is pivotal about a pivot axis, said swing arm assembly being pivotally disposable between an at least partially raised position and a clamped position, wherein said base of said swing arm assembly extends at least partially between said first fixed support panel and said second fixed support panel, at least while said swing arm assembly is disposed in said at least partially raised position, a stop disposed between said first fixed support panel and said second fixed support panel, wherein said base of said swing arm assembly engages said stop while said swing arm assembly is disposed in said at least partially raised position, said swing arm assembly further comprising a pivoting pressure plate disposed at least partially offset from said second end of said base, said pivoting pressure plate defining a panel engaging surface thereon, said pivoting pressure plate being at least partially movable, and a biasing device configured to normally bias said swing arm assembly into said at least partially raised position until an opposing weight is applied to said base of said swing arm assembly to position said swing arm assembly into said clamped position, wherein said panel engaging surface of said pivoting pressure plate and said at least one panel engaging surface of said at least one fixed support panel are disposed in an at least partially facing and spaced relation to one another, wherein a panel support area is defined as being between said pivoting pressure plate and said at least one fixed support panel, and above a portion of said base of said swing arm.

19. The support assembly as recited in claim 18 wherein said biasing device is connected between said second end of said base of said swing arm assembly and a biasing support disposed above said base of said swing arm assembly.

20. The support assembly as recited in claim 19 wherein said biasing support is disposed between said first fixed support panel and said second fixed support panel, and wherein said biasing device is configured to pull said base of said swing arm into said at least partially raised position.

* * * * *